US006691462B2

(12) United States Patent
Oestermann

(10) Patent No.: US 6,691,462 B2
(45) Date of Patent: Feb. 17, 2004

(54) SLIDING STRUCTURE

(75) Inventor: Markus Oestermann, Sendenhorst (DE)

(73) Assignee: Schüco International KG, Bielefeld (DE)

( * ) Notice: Subject to any disclaimer, the term of this patent is extended or adjusted under 35 U.S.C. 154(b) by 0 days.

(21) Appl. No.: 09/792,885

(22) Filed: Feb. 23, 2001

(65) Prior Publication Data

US 2001/0017013 A1 Aug. 30, 2001

(30) Foreign Application Priority Data

Feb. 26, 2000 (DE) ..... 200 03 563

(51) Int. Cl.[7] ..... E05D 15/10
(52) U.S. Cl. ..... 49/213; 292/36
(58) Field of Search ..... 49/176, 177, 178, 49/180, 213, 449, 450, 209, 193, 127, 125, 128, 188, 189; 292/35, 36, 37, 40, 34, 41

(56) References Cited

U.S. PATENT DOCUMENTS 4,222,201 A * 9/1980 Yanessa ..... 49/189
4,949,504 A * 8/1990 Bortoluzzi ..... 49/130
5,398,447 A * 3/1995 Morse ..... 49/185
5,423,144 A * 6/1995 Santos ..... 49/189
5,548,926 A * 8/1996 Sjoholm ..... 49/127
5,992,907 A * 11/1999 Sheldon et al. ..... 292/34
5,996,285 A * 12/1999 Guillemet et al. ..... 49/213
6,276,092 B1 * 8/2001 Neo ..... 49/183
6,336,246 B1 * 1/2002 Giovannetti ..... 49/128

FOREIGN PATENT DOCUMENTS

AU 728945 * 1/2001

* cited by examiner

*Primary Examiner*—Jerry Redman
(74) *Attorney, Agent, or Firm*—Henry M. Feiereisen

(57) ABSTRACT

A sliding structure, includes a frame, at least one sliding sash received in the frame, with the sliding sash having upper and lower locking bars. An actuating mechanism is provided for moving the upper and lower locking bars of the sliding sash in opposite directions, to thereby allow attachment of the sliding sash to the frame at several positions.

14 Claims, 6 Drawing Sheets

SLIDING STRUCTURE

CROSS-REFERENCES TO RELATED APPLICATIONS

This application claims the priority of German Patent Application Serial No. 200 03 563.0, filed Feb. 26, 2000, the subject matter of which is incorporated herein by reference.

BACKGROUND OF THE INVENTION

The present invention relates, in general, to a sliding structure.

In general, a sliding structure involved here includes a frame and at least one sliding sash configured for displacement in upper and lower guides of the frame and lockable in several positions in the frame. Such sliding structures are typically used as glass fronts of balconies or walls in a building.

Sliding structures are known having several sliding panels or sashes mounted in a frame for sliding in horizontal direction. Individual sashes can hereby shift from a side-by-side disposition in which they form a sealed glass front to a position in which they are located behind one another so as to provide an opening to allow ventilation or cleaning. The sashes may be arranged either in a single plane in which case the sashes have to be moved out of the plane for positioning behind one another, or in several planes in which case the movement into a position behind one another can be carried out in a simple manner.

Apart from sliding-type sashes, different types of sashes are known for use, for example, pivoting sashes, pivoting and tilting sashes, tilting sashes or tilting and swinging sashes. It is also possible to provide several sash areas with more than one panels and/or more than one fixed panel.

Conventional sliding structures suffer shortcomings because opening and closing of individual sliding sashes, e.g. for cleaning and ventilating, is fairly complicated and securement of the sliding sashes is unsatisfactory. By means of an actuating mechanism, a locking pin is normally moved from a pocket on the neighboring sash, or to the upper or lower side of the frame in order to move the sash. A turning of the sash requires then another actuating mechanism to engage a locking pin at the top and subsequently a locking pin at the bottom of the sash in respective latching receptacles in the frame to thereby secure the sash in the frame. Thereafter, upper and lower sliding bars on a side opposite to the locking bars are then sequentially withdrawn in a further step out of the frame. In this position, the sash can be pivoted about the locking bars. Thus, a conversion from the sliding position into a pivoting position of the sash requires separate manipulation of four individual bars.

The movement of the actuating mechanisms separate from one another is cumbersome for the user and risky because a detachment of the guide in the frame by one actuating mechanism without simultaneous securement of the sash by a further actuating mechanism may result in a disengagement of the sash from the frame. Moreover, the various actuating mechanisms are disposed far apart from one another when high sliding sashes are involved, rendering an opening of the sash nearly impossible for a single person.

It would thus be desirable and advantageous to provide an improved sliding structure, obviating prior art shortcomings and having sashes which are supported for at least partial displacement and configured to allow a simple and secure opening and closing thereof, while yet being simple in structure and cost-efficient to fabricate.

SUMMARY OF THE INVENTION

The present invention provides for a sliding structure, which includes a frame, at least one sliding sash received in the frame and having upper and lower locking bars, and an actuating mechanism for moving the upper and lower locking bars of the sliding sash in opposite directions, to thereby allow attachment of the sliding sash to the frame at several positions.

By configuring the sliding sash in accordance with the present invention, a single actuating mechanism can be used to implement a release of the locking bars and thereby allow a shift, and a locking for allowing a pivoting or closing of the sash. Operation of the sash is thus easy to handle and can be realized with one hand. Incorrect operation is avoided because the locking bars engage upper and lower receptacles at a same time so that a tilting of the sash as a result of unilateral securement is prevented.

According to another feature of the present invention, the upper and lower locking bars are movable by the actuating mechanism between an extended position in which the locking bars engage the sash and lock them in place, and a retracted position in which the sash can be slid. Suitably, the frame includes spaced-apart points of attachment for engagement by a locking bar, thereby ensuring a particularly stable securement of the sash. As an alternative, it may also be possible to use the actuating mechanism for movement of clamping members to effect a infinitely variable securement of the sash in the frame.

According to another feature of the present invention, the sliding sash includes sliding bars for guiding the sash in the upper and lower guides of the frame, wherein a safety mechanism is provided for preventing an inadvertent withdrawal of the sliding bars from the frame when the locking bars are disengaged from the locking position.

By providing the sash with upper and lower sliding bars which are guided in the frame, when extended, and detachable from the frame, when retracted, the sash can be guided securely at four locations in the frame and can be pivoted out of the frame after disengagement of the sliding bars. Pivoting of the sash can be executed in a simple manner when moving the sliding bars by an actuating mechanism in opposite directions. Of course, it is possible to move the locking bars and the sliding bars by a single actuating mechanism. In this case, it may be suitable to mount corner angles to the sash to realize an absolute security against inadvertent detachment of a sash.

In the description, the term "sliding bar" denotes any type pf sliding hardware, e.g., rollers which may be located beneath the sashes so that the weight force is applied upon the rollers. It is also possible to provide the sashes in hung configuration, with the sashes suspended from the upper edge of the frame. Another option includes the incorporation of sliding panels which are supported securely on sliding tracks for displacement along the track. In this case, further guide elements are provided to conduct the sashes in the given tracks.

According to another feature of the present invention, the sliding structure has two such sashes which include at their confronting sides the upper and lower locking bars and at their sides facing away the upper and lower sliding bars. The assembly is simplified to slidingly guide the sashes in a slot formed in the frame.

To safeguard against burglary, one of the sashes may include a closure piece which can be moved by the actuating mechanism into a pocket of the neighboring sash so as to interlock both sashes to form a unitary assembly. In this way, it becomes much more difficult to pry open the sashes by a crowbar or like tool.

Suitably, both sashes may be movably retained in the frame. Of course, it is conceivable to support three or more such sashes in the frame.

BRIEF DESCRIPTION OF THE DRAWING

Other features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
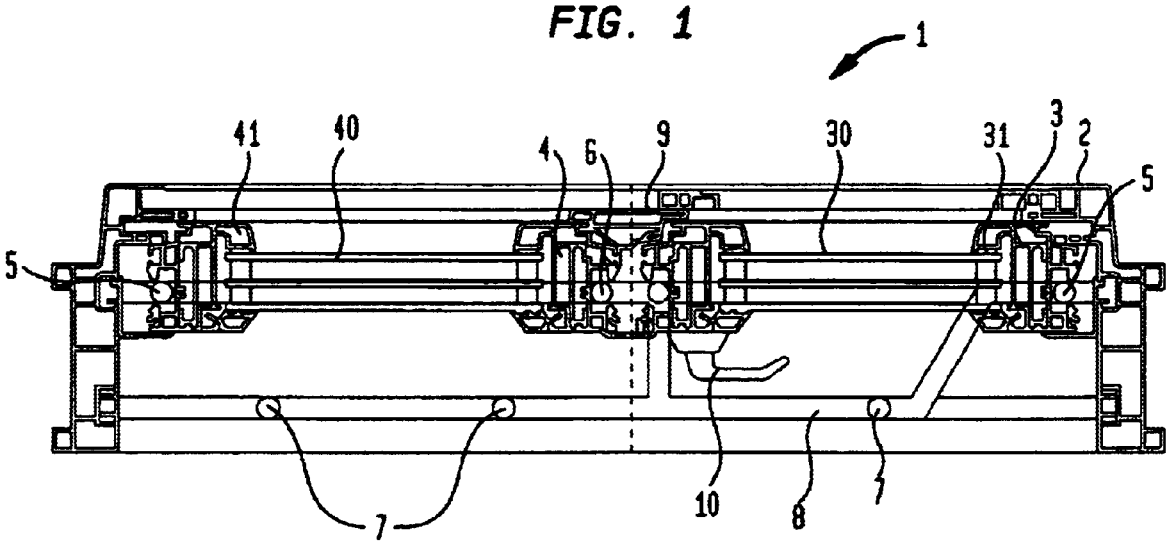
FIG. 1 is a plan view of one embodiment of a sliding structure according to the present invention, illustrating the sashes in closed position.

Throughout all the Figures, same or corresponding elements are generally indicated by same reference numerals.

Turning now to the drawing, and in particular to FIG. 1, there is shown a plan view of one embodiment of a sliding structure according to the present invention, generally designated by reference numeral 1 and including a frame 2 and two sliding panels or sashes 3, 4 arranged in the frame 2. Each of the sashes 3, 4 includes a sliding bar 5 and a locking bar 6, with the locking bar 6 of each sash 3, 4 disposed at a central location of the sliding structure 1 and with the sliding bar 5 of each sash 3, 4 disposed at an outer location of the sliding structure 1. The sash 3 is configured for supporting an insulating glass pane 30 which is clamped in a frame profile 31, with the frame profile 31 sealingly received in the frame 2 by conventional sealing material. Likewise, the sash 4 includes a frame profile 41 for sealingly retaining an insulating glass pane 40.

The frame 2 is formed at the inwardly directed side with a slot 8 at the top and a slot 8 at the bottom of the frame 2 (only one slot 8 is visible here) for guiding the sashes 3, 4. Several locking points 7 are formed by recessing the slots 8 and reinforced by a metal bush 20, as shown in more detail in FIG. 8. Persons skilled in the art will understand that each of the sashes 3, 4 has a locking bar 6 at the top and a locking bar 6 at the bottom. As the locking bars 6 are of an identical construction, hence only the locking bar 6 shown in the drawing will hereinafter be described in detail. However, it will be understood by persons skilled in the art that a description of one locking bar 6 is equally applicable to the other locking bar.

In its center, the sash 4 is provided with an overlap section 9 upon which the sash 3 sealingly rests in the closed position, as shown in FIG. 1.

Figure 8:
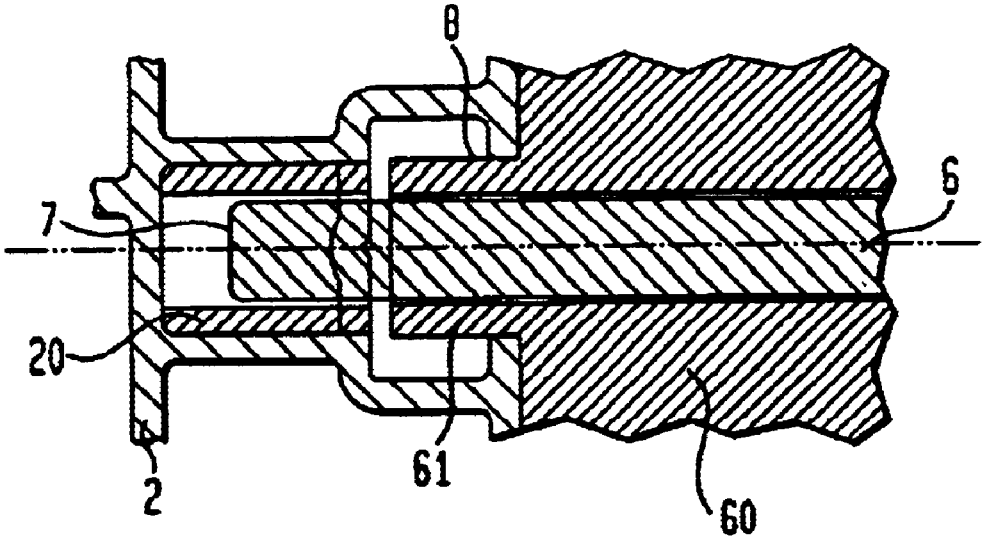
FIG. 8 is a sectional cutaway view, on an enlarged scale, of a locking bar of a sliding sash.

The locking bar 6 can be moved by an actuating mechanism 10 in the form of a handle. In the locked position, the locking bar 6 of each sash 3, 4 engages the bush 20 at the respective one of the locking points 7 so as to prevent a horizontal movement of the sashes 3, 4. As shown in FIG. 8, the locking bar 6 is guided in a guide shoe 60 which rests on a portion of the frame 2. The guide shoe 60 is formed in the outer region thereof with a prolongation 61 for engagement into the slot 8 of the frame 2.

Each of the sashes 3, 4 is thus securely guided in sliding position at four locations, with the locking bars 6 engaging two locking points 7 and the sliding bars 5 engaging the slots 8. As the locking bars 6 at the top and the bottom of the sliding structure 1 are engaged at the same time in locking points 7, an inadvertent separation of the sashes 3, 4 can be securely prevented even when the sashes 3, 4 occupy the pivoting position.

Figure 7:
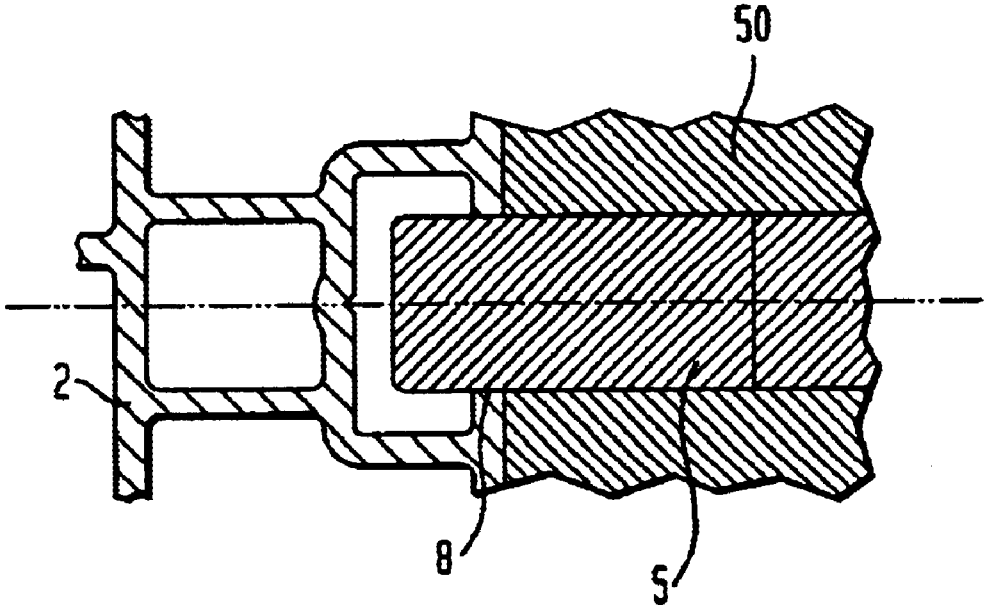
FIG. 7 is a sectional cutaway view, on an enlarged scale, of a sliding bar of a sliding sash.

As shown by way of example in FIG. 7, each sliding bar 5 has a pin-like configuration and is guided in a guide shoe 50. The outer end of the sliding bar 5 is guided in the slot 8 of the frame 2. By means of an unlocking mechanism, it is possible to move the sliding bars 5 into the sliding sashes 3, 4, respectively, so that the forward end of the sliding bar 5 is no longer engaged in the slot 8 of the frame 2, and the sliding sashes 3, 4, respectively, are no longer anchored at this location to the frame 2.

Figure 2:
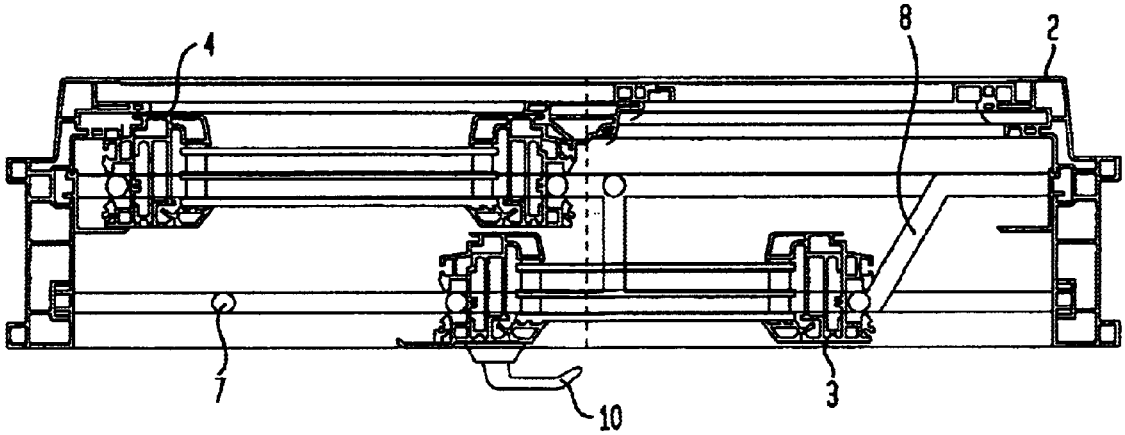
FIG. 2 is a plan view of the sliding structure of FIG. 1, illustrating one sliding sash in a ventilating position.

The sliding structure 1 operates as follows:

In FIG. 1, the sliding structure 1 occupies the closed position, with both sashes 3, 4 sealingly received by the frame 2. When opening one of the sliding sashes 3, 4, here the sliding sash 3, the handle 10 is actuated to move the locking bars 6 in opposite directions and thereby disengage the locking bars 6 on top and bottom from the respective locking points 7, to thereby permit a displacement of the sash 3 inwardly along the slot 8. The sash 3 is initially moved inwardly to the side of the handle 10, whereby two separate tracks are provided for locking bar 6 and sliding bar 5. Thus, the sliding structure 1 becomes ajar and the sliding sash 3 occupies a position in which ventilation is possible. This position is shown in FIG. 2.

Figure 3:
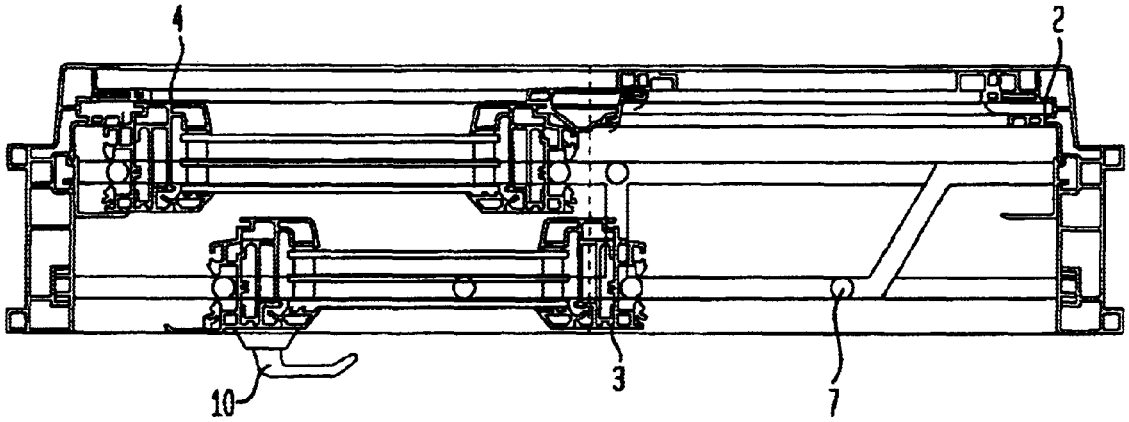
FIG. 3 is a plan view of the sliding structure of FIG. 1, illustrating one sliding sash in cleaning position.

To further open the sliding structure 1, the sliding sash 3 may be moved in a linear direction into a position behind the sliding sash 4, as shown in FIG. 3. An inadvertent shift of the sliding sash 3 can be prevented by securing the upper and lower locking bars 6 in respective locking points 7.

Figure 4:
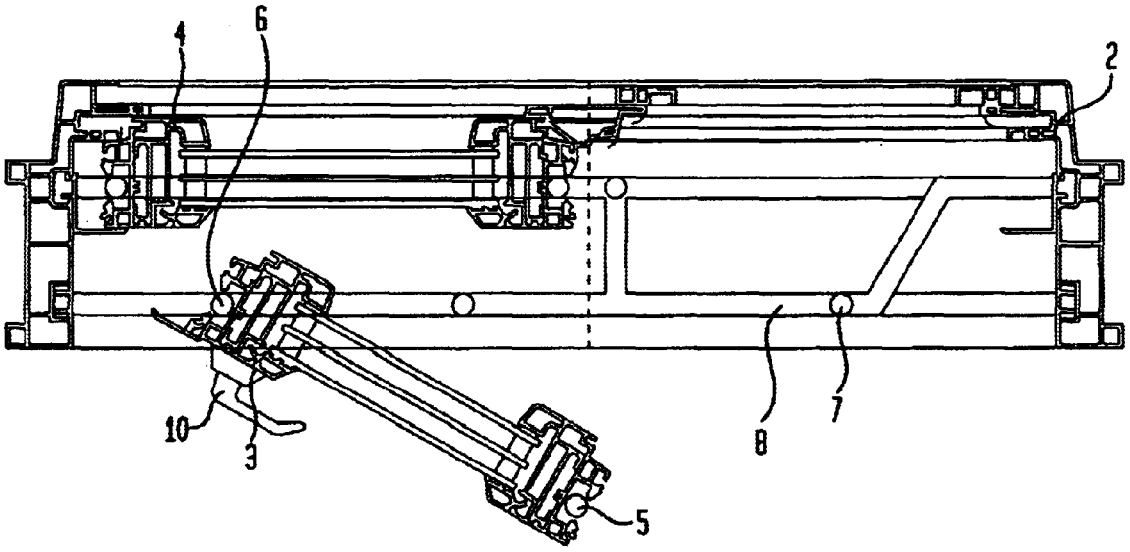
FIG. 4 is a plan view of the sliding structure of FIG. 1, illustrating one sliding sash in outwardly pivoted position.

In order to permit cleaning of the outside of the glass pane 30, the sash 3 has to be swung about the axis of the locking bar 6 to provide access to the outside surface from the inside. This is realized by using the actuating mechanism 10 or a further, e.g. electric actuating mechanism, to detach the sliding bar 5 from the slot 8 so that the sash 3 is held only by the locking bars 6 on top and bottom of the sliding structure 1. As a result, the sash 3 can now be pivoted into a position shown in FIG. 4.

Figure 5:
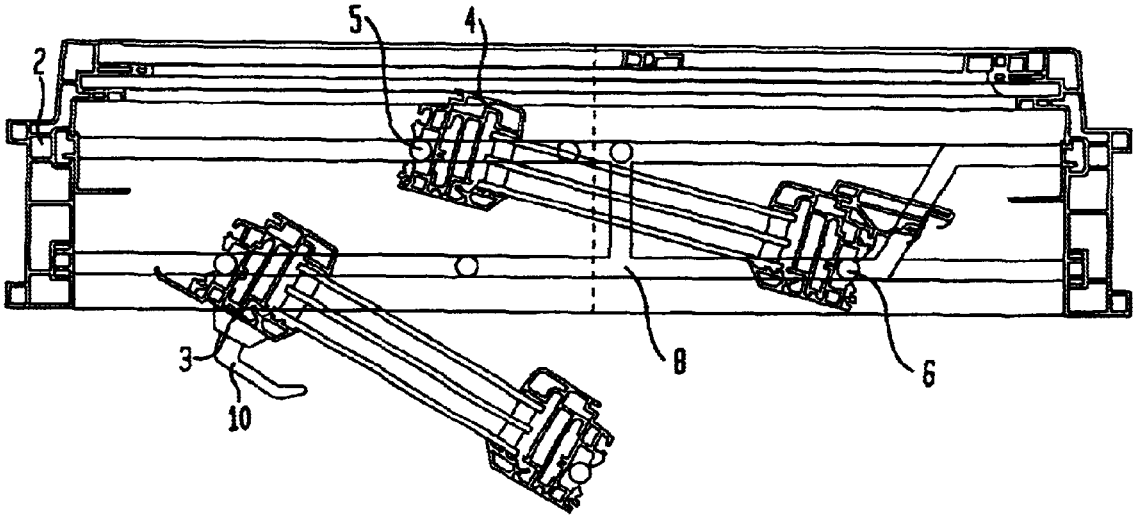
FIG. 5 is a plan view of the sliding structure of FIG. 1, illustrating two opened sliding sashes.
Figure 6:
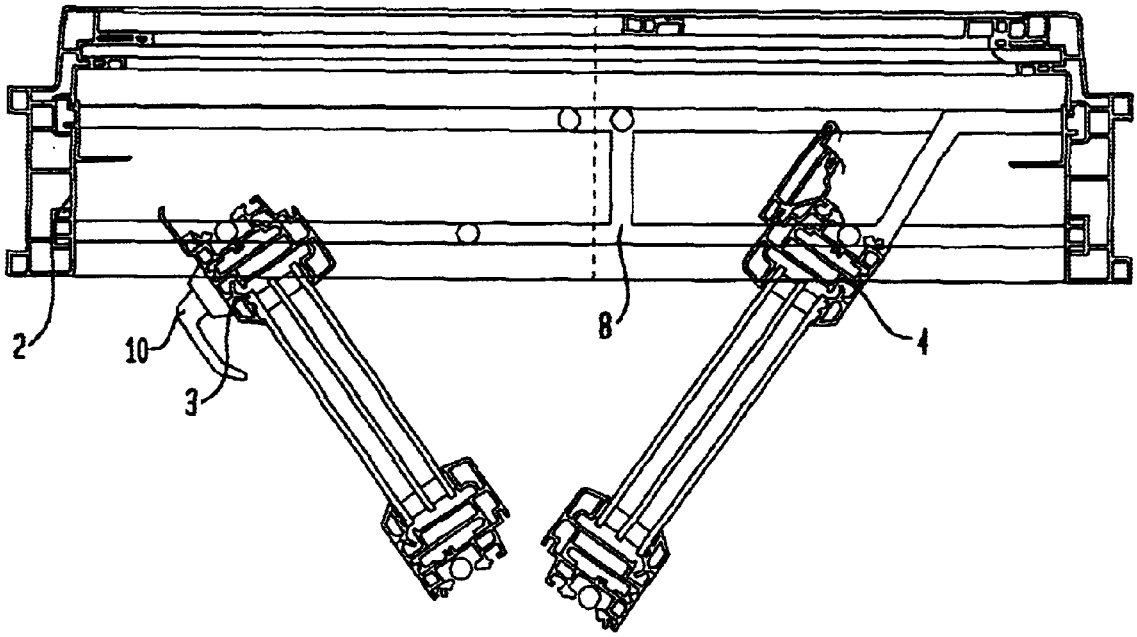
FIG. 6 is a plan view of the sliding structure of FIG. 1, illustrating two sliding sashes in positions suitable for cleaning purposes.

To allow also cleaning of the other sash 4, it is only necessary to move the sash 4 from the left position to the right until the locking bars 6 (only one is visible here) engage respective ones of the locking points 7, as shown in FIG. 5. Then, an actuating mechanism removes the sliding bars 5 from the upper and lower slots 8 so that the sliding sash 4 can now be pivoted about the axis of the locking bars 6, as shown in FIG. 6.

Figure 9:
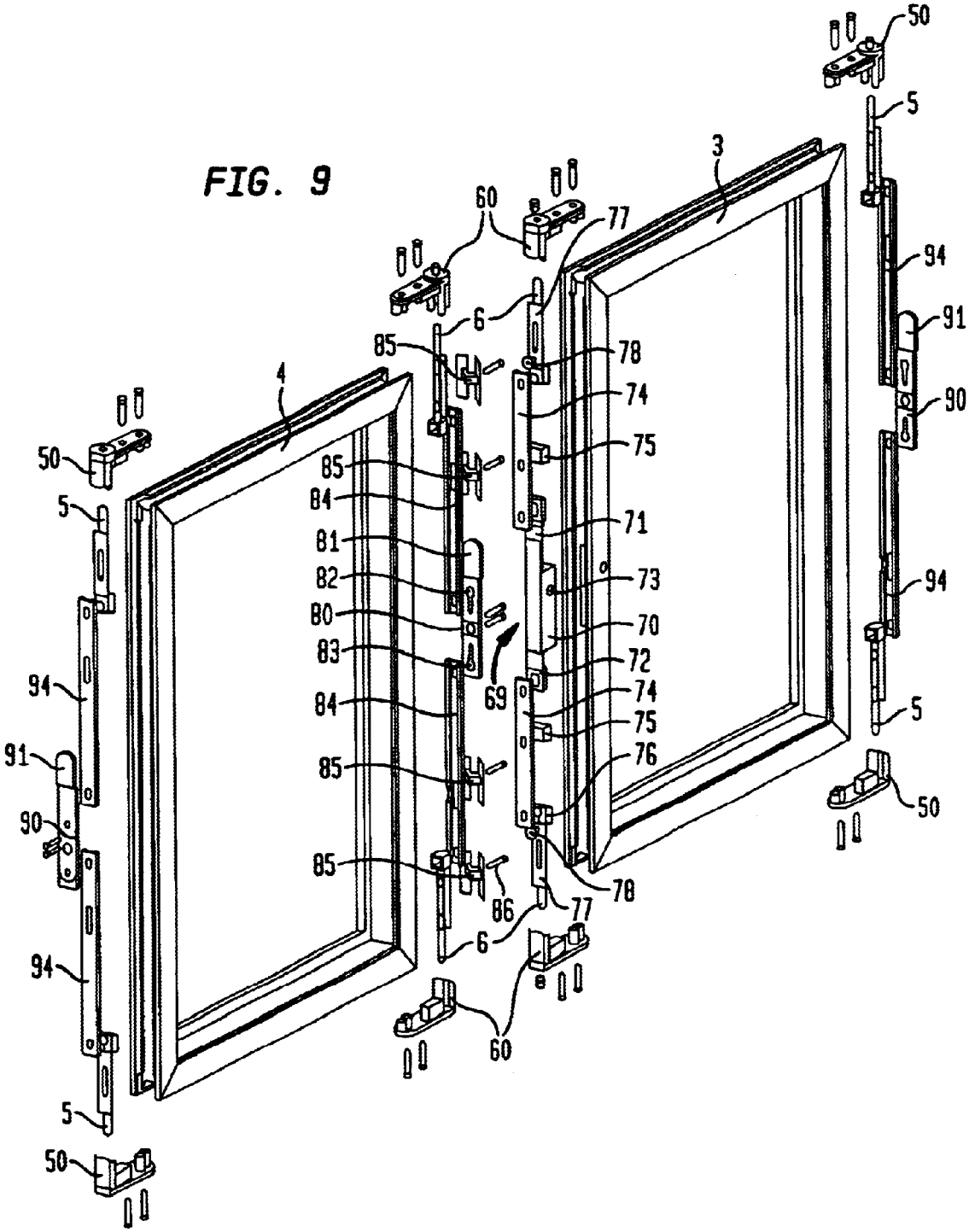
FIG. 9 is a perspective view in exploded illustration of the sliding structure according to the present invention, showing in detail an actuating mechanism for operating the locking and sliding bars.

Turning now to FIG. 9, there is shown a perspective view in exploded illustration of the sliding structure 1 according to the present invention, showing in detail an actuating mechanism for operating the sliding and locking bars 5, 6. The right sliding sash 3 is provided with a linkage mechanism, generally designated by reference numeral 69 and including a casing 70 having an opening 73 for attachment of the handle 10 (not shown here). The linkage mechanism 69 includes two link rods 71, 72 extending out from the casing 70 from opposite sides and operatively connected to the handle 10, such that a turning of the handle 10 moves the link rods 71, 72 in opposite directions, i.e. either inwards into the casing 70 or outwards out of the casing 70. Each of the link rods 71, 72 is connected to a bracket 74 which is linked at its side distal to the casing 70 via a coupler 76 to a finger clamp 77 which embraces the locking bar 6. The finger clamp 77 has further attached thereon a mushroom-shaped locking pin 78 which is moved in a vertical direction with the finger clamp 77, when the linkage mechanism 69 is actuated. In addition, the brackets 74 support rollers 75 for movement in vertical direction and engagement in complementary locking pieces 85 of the neighboring sash 4 for interconnecting the sashes 3, 4.

Mounted to the left sash 4 is an overlap linkage 80 which includes a lever 81 for vertically moving an upper pin 82 and a lower pin 83 in opposite directions. The pins 82, 83 are each coupled to a rail 84 which is guided in a groove of the sash 4. Secured to the linkage-distal end of the rails 84 are the locking bars 6 which are guided in the slide shoes 60. Thus, when actuating the lever 81, the locking bars 6 can be moved in opposite directions, thereby engaging or disengaging from the locking points 7.

As indicated in FIG. 9, the locking pieces 85 are secured by fastening screws 86 to the locking bars 6 and positioned inwardly of the brackets 74 of the linkage mechanism 70 in the travel path of the rollers 75. Interlocking of the sliding sashes 3, 4 is implemented by bringing the lever 81 of the overlap linkage 80 and the linkage mechanism 69 into the closing position for engagement of the locking bars 6 in the desired locking points 7. In this position, the rollers 75 are locked in the locking pieces 85 and the mushroom-shaped locking pins 78 in further locking pieces 85 so that the sliding sashes 3, 4 cannot be moved apart by force in horizontal direction.

The sliding bars 5 are moveable in opposite directions via a further overlap linkage 90 though operation of a lever 91, whereby, the sliding bars 5 are connected via locking rods 94 to the overlap linkage 90.

Figure 10:
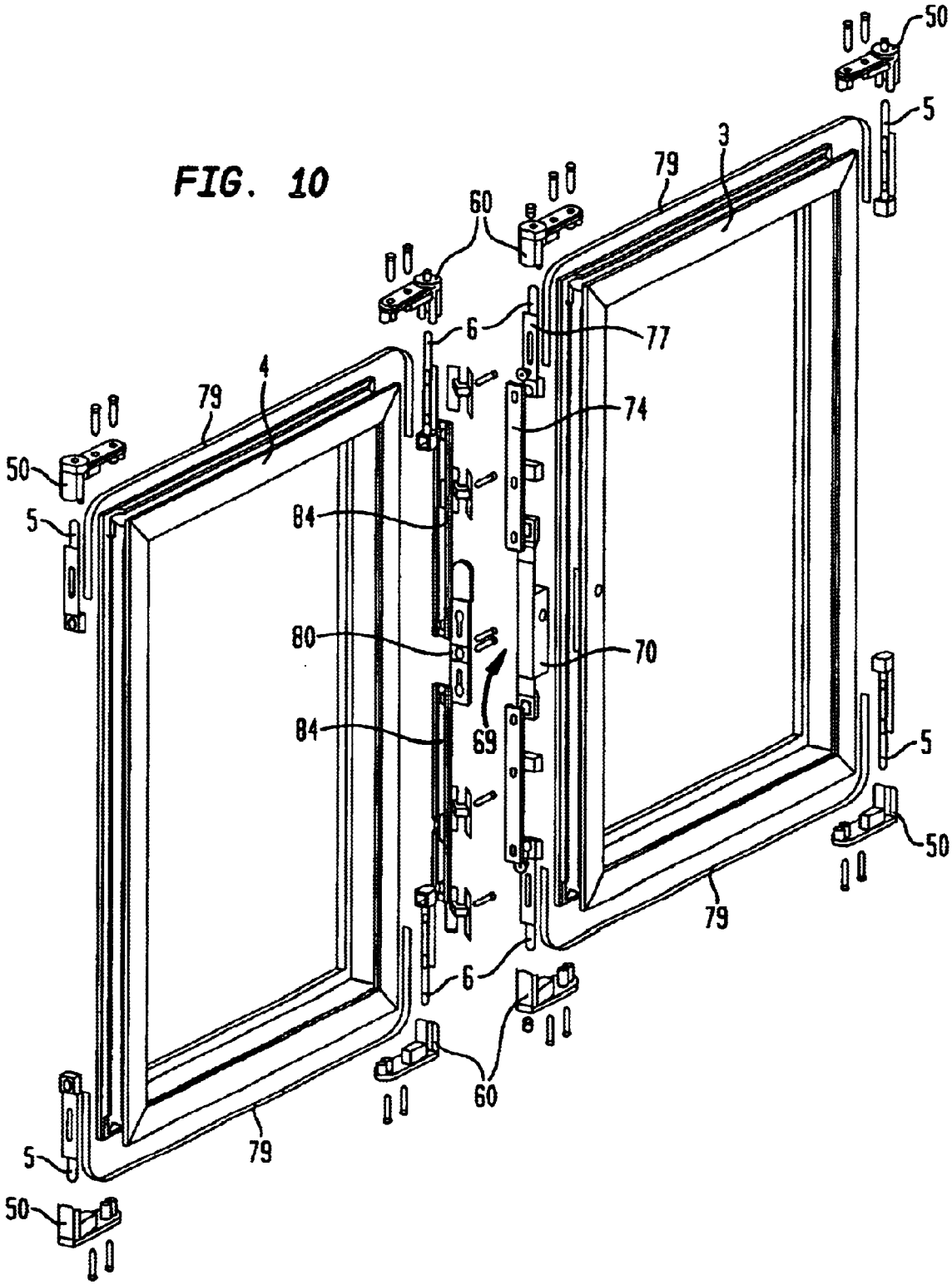
FIG. 10 is a perspective view in exploded illustration of a variation of a sliding structure according to the present invention, showing in detail a modified actuating mechanism.

Turning now to FIG. 10, there is shown a perspective view in exploded illustration of a variation of a sliding structure 1 according to the present invention. Parts corresponding with those in FIG. 9 are denoted by identical reference numerals and not explained again. In this embodiment, provision is made for a single actuating mechanism for operating the sliding bars 5 and the locking bars 6 of a sash. The right hand sash 3 is provided with the linkage mechanism 69 for vertically adjusting the locking bars 6 via the brackets 74 and the finger clamps 77 in a manner described in conjunction with FIG. 9. In addition, each of the finger clamps 77 is linked to the sliding bars 5 by steel bands 79, illustrated schematically here, and angled at their opposite ends for connection to the finger clamps 77 and the sliding bars 5, respectively. Through actuation of the handle 10, received in the opening 73 of the casing 70 of the linkage mechanism 69, the locking bars 6 can be disengaged from the locking points 7, while the sliding bars 5 are moved at the same time into the slots 8 of the frame 2. As a consequence, the sash 4 can be shifted in the frame. Pivoting of the sash 4 is implemented by actuating the linkage mechanism 69 such that the locking bars 6 engage the locking points 7, while the sliding bars 5 are disengaged from the slots 8 and thus guidance in the frame 2. Thus, the sash 4 can be pivoted about the locking bars 6. An incorrect operation is positively precluded as the sashes 3, 4 are secured to the frame 2 in any position of the actuating mechanism.

The overlap linkage 80 mounted to the left sash 4 operates in a similar manner to actuate the locking bars 6 and the sliding bars 5, by using steel bands 79 to connect the overlap linkage 80 with the sliding bars 5.

In the closed position of the sliding structure, shown in FIG. 1, the sashes 3, 4 are held in the frame 2 via the guide shoes 50. Of course, it is also possible to utilize different attachment and guiding means in the area of the sliding bars 5 to ensure a secure retention of the sashes 3, 4 upon the frame 2, when the sliding bars 5 are disengaged.

While the invention has been illustrated and described as embodied in a sliding structure, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A sliding structure for use as a glass front, comprising:

a frame formed with slotted tracks on opposite ends;

at least one sash received in the frame, said sliding sash having a pair of vertically adjustable first bars on one side of the sash and a pair of vertically adjustable second bars on an opposite side of the sash, said first and second bars moving in the slotted tracks; and an actuator moving the first bars in opposite directions between a locking position in which the sash is locked to the frame and a release position in which the first bars are idle, and moving the second bars between an engagement position in which the second bars are guided in the slotted tracks and a disengagement position in which the second bars are idle, thereby selectively allowing attachment of the sash to the frame at several positions and displacement of the sash, without risk of disengagement of the sash from the frame.

2. The sliding structure of claim 1, wherein the frame has points of attachments spaced from one another in the slotted tracks for interaction with the first bars.

3. The sliding structure of claim 2, wherein the points of attachment are defined by recesses in the slotted tracks.

4. The sliding structure of claim 1, wherein the actuator includes a single actuating mechanism for adjusting the first and second bars.

5. The sliding structure of claim 4, wherein the actuator is so configured as to move the locking bars and the sliding bars in opposite directions.

6. The sliding structure of claim 1, wherein the actuator is so configured as allow pivoting of the sash about the first bars, when the first bars occupy their locking position, while the second bars occupy their disengagement position.

7. The sliding structure of claim 1, and further comprising a second one of said sash, said two sashes being so disposed that first bars are arranged on confronting sides of the sashes, and the second bars are arranged on sides of the sashes facing away from one another.

8. The sliding structure of claim 7, and further comprising a clamping means for interconnecting the sashes, said clamping means including a closure piece mounted on one sash and movable by the actuator for engagement in a receiving member of the other sash.

9. The sliding structure of claim 7, and further comprising a clamping means for interconnecting the sashes, said clamping means including a closure piece mounted on one sash and movable by the first actuating mechanism for engagement in a receiving member of the other sash.

10. The sliding structure of claim 1, and further comprising a second one of said sash, said two sashes being so disposed that first bars are arranged on confronting sides of the sashes, and the second bars are arranged on sides of the sashes facing away from one another.

11. A sliding structure for use as a glass front, comprising:

a frame formed with slotted tracks on opposite ends;

at least one sash received in the frame, said sliding sash having a pair of vertically adjustable first bars on one side of the sash and a pair of vertically adjustable second bars on an opposite side of the sash, said first and second bars moving in the slotted tracks; and a first actuating mechanism for moving the first bars in opposite directions between a locking position in which the sash is locked to the frame and a release position in which the first bars are idle; and a second actuating mechanism for moving the second bars between an engagement position in which the second bars are guided in the slotted tracks and a disengagement position in which the second bars are idle, thereby selectively allowing attachment of the sash to the frame at several positions and displacement of the sash, without risk of disengagement of the sash from the frame.

12. The sliding structure of claim 11, wherein the frame has points of attachments spaced from one another in the slotted tracks for interaction with the first bars.

13. The sliding structure of claim 12, wherein the points of attachment are defined by recesses in the slotted tracks.

14. The sliding structure of claim 11, wherein the first and second actuating mechanisms are so configured as allow pivoting of the sash about the first bars, when the first bars occupy their locking position, while the second bars occupy their disengagement position.

* * * * *